United States Patent [19]

Zyla

[11] 3,954,268

[45] May 4, 1976

[54] DRAG RACING GAME APPARATUS

[76] Inventor: Gregory J. Zyla, P.O. Box 185, Pillow, Pa. 17080

[22] Filed: Dec. 13, 1974

[21] Appl. No.: 532,734

[52] U.S. Cl. ..... 273/134 CA; 273/134 C; 273/134 D; 273/143 D

[51] Int. Cl.[2] ..... A63F 3/00

[58] Field of Search ..... 273/134

[56] References Cited

UNITED STATES PATENTS

| | | | |
|---|---|---|---|
| 1,139,949 | 5/1915 | Betschart | 273/134 CA UX |
| 1,148,737 | 8/1915 | Atkins | 273/134 CA |
| 3,044,779 | 7/1962 | Hvizdash | 273/134 CA |
| 3,738,659 | 6/1973 | Partridge | 273/134 AG |

FOREIGN PATENTS OR APPLICATIONS

| | | | |
|---|---|---|---|
| 1,489,807 | 6/1967 | France | 273/134 CA |

*Primary Examiner*—Delbert B. Lowe
*Attorney, Agent, or Firm*—Berman, Aisenberg & Platt

[57] ABSTRACT

An automobile drag racing game comprising a playing board having two parallel lanes, each of which is designed to accommodate a playing piece in the form of a miniature drag racing car, so as to conduct a drag race between the two cars under conditions simulating those of an actual race. The playing board is divided into four transverse zones corresponding with the portions of a drag race run in first, second, third and fourth gears. Movement of the cars is controlled by dice, or in another embodiment by a number wheel actuated by a gear shift lever which can be shifted into first through fourth gears. The numbers thus randomly selected are utilized to determine the number of feet which the car may advance in any given gear by reference to a conversion chart with which each player is provided. Each conversion chart is calculated to produce racing performance characteristics of a well known type of car and driver. Apparatus is provided for simulating the various problems which may be encountered in a real life race as the cars pass through the various zones. These problems might be of the type which slow a car down or put it out of the race entirely. A further feature of the race is the provision of apparatus for calculating the elapsed time for each car as it passes the finish line, as well as its speed. These figures may then be used for determining the winner of an extremely close race.

5 Claims, 12 Drawing Figures

20

MPH CHART

| | A | B | C | D | E | F | G | H | I | J |
|---|---|---|---|---|---|---|---|---|---|---|
| 2 – | 152.9 | 152.6 | 151.8 | 149.9 | 149.0 | 148.1 | 147.1 | 146.2 | 145.2 | 144.3 |
| 3 – | 152.8 | 152.5 | 151.7 | 149.8 | 148.9 | 148.0 | 147.0 | 146.1 | 145.1 | 144.2 |
| 4 – | 152.7 | 152.4 | 151.6 | 149.7 | 148.8 | 149.9 | 146.9 | | | |
| 5 – | 152.6 | 152.3 | 151.9 | 150.0 | 148.7 | 147.8 | | | | |
| 6 – | 152.5 | 152.1 | 151.5 | 149.6 | 150.0 | | | | | |
| 7 – | 152.4 | 152.0 | 151.4 | 149.5 | | | | | | |
| 8 – | 152.3 | 151.9 | 151.3 | | | | | | | |
| 9 – | 152.1 | 151.8 | | | | | | | | |
| 10 – | 152.0 | 151.7 | | | | | | | | |
| 11-12 – | 153.0 | 151.6 | | | | | | | | |

30

ELAPSED TIME CHART

| A | B |
|---|---|
| 2 – 8.80 | 2 – 8.90 |
| 3 – 8.81 | 3 – 8.91 |
| 4 – 8.82 | 4 – 8.92 |
| 5 – 8.83 | 5 – 8.93 |
| 6 – 8.84 | 6 – |
| 7 – | 7 – |
| 8 – | 8 – |
| 9 – | 9 – |
| 10 – | 10 – |
| 11-12 – 8.89 | 11-12 – 8.99 |

| C | D | E | F |
|---|---|---|---|
| 2 – 8.95 | 2 – 9.00 | 2 – 9.10 | 2 – 9.20 |
| 3 – 9.00 | 3 – | 3 – | 3 – |
| 4 – 8.99 | 4 – | 4 – | 4 – |
| 5 – 9.04 | 5 – | 5 – | 5 – |
| 6 – 8.97 | 6 – | 6 – 9.14 | 6 – |
| 7 – 9.02 | 7 – 9.05 | 7 – | 7 – |
| 8 – 8.96 | 8 – 9.06 | 8 – | 8 – |
| 9 – 9.01 | 9 – | 9 – | 9 – |
| 10 – 8.98 | 10 – | 10 – | 10 – |
| 11-12 – 9.03 | 11-12 – 9.09 | 11-12 – 9.19 | 11-12 – 9.29 |

| G | H | I | J |
|---|---|---|---|
| 2 – 9.30 | 2 – 9.40 | 2 – 9.50 | 2 – 9.60 |
| 3 – 9.31 | 3 – | 3 – | 3 – 9.61 |
| 4 – | 4 – | 4 – | 4 – |
| 5 – | 5 – 9.43 | 5 – | 5 – |
| 6 – | 6 – | 6 – 9.54 | 6 – |
| 7 – | 7 – | 7 – | 7 – |
| 8 – | 8 – 9.46 | 8 – | 8 – |
| 9 – | 9 – | 9 – | 9 – |
| 10 – | 10 – | 10 – | 10 – |
| 11-12 – 9.39 | 11-12 – 9.49 | 11-12 – 9.59 | 11-12 – 9.69 |

35

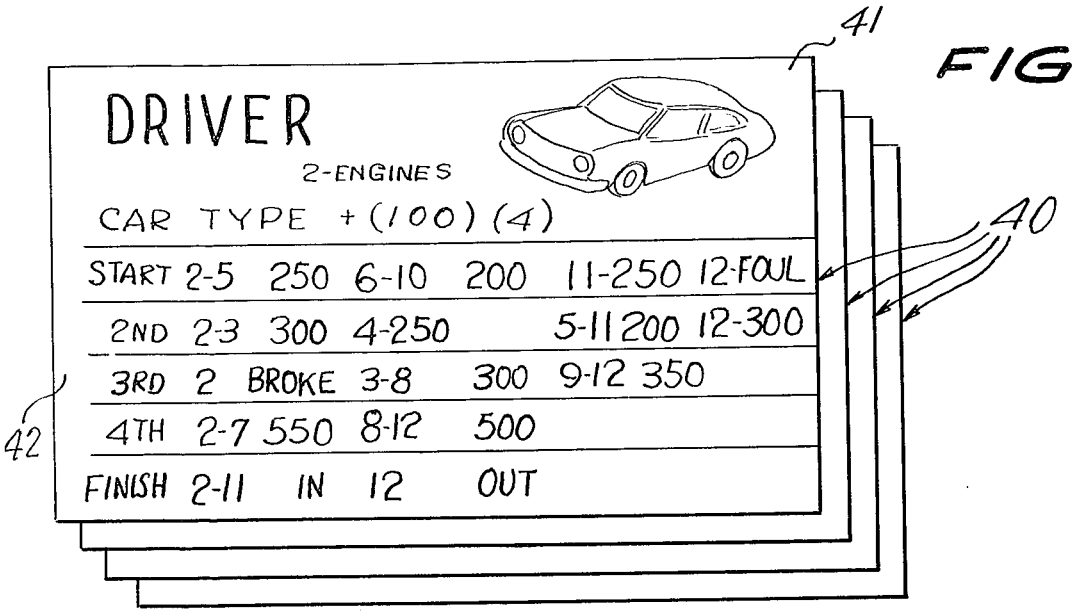
FIG. 5.
FIG. 6.
60
| BROKE CHART | |
|---|---|
| START | 200 |
| 2ND GEAR | 200 |
| 3RD GEAR | 300 |
| 4TH GEAR | 500 |
FIG. 7.
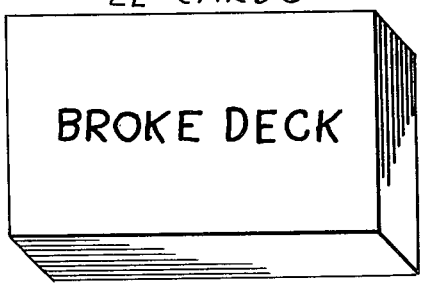
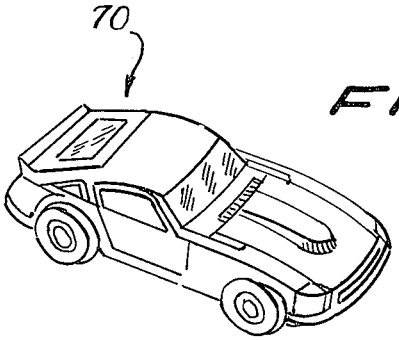
FIG. 8.

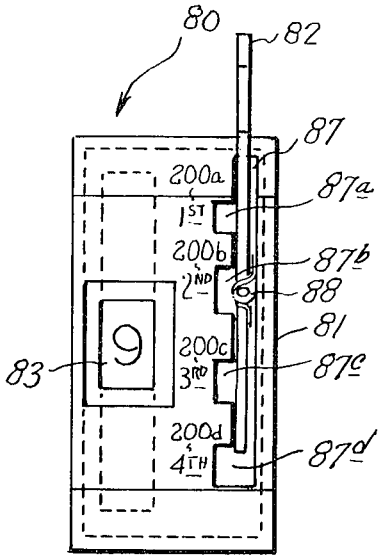
FIG. 10.
FIG. 11.
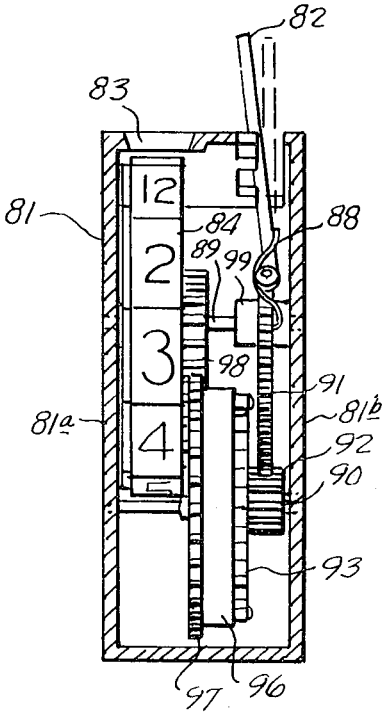
FIG. 12.
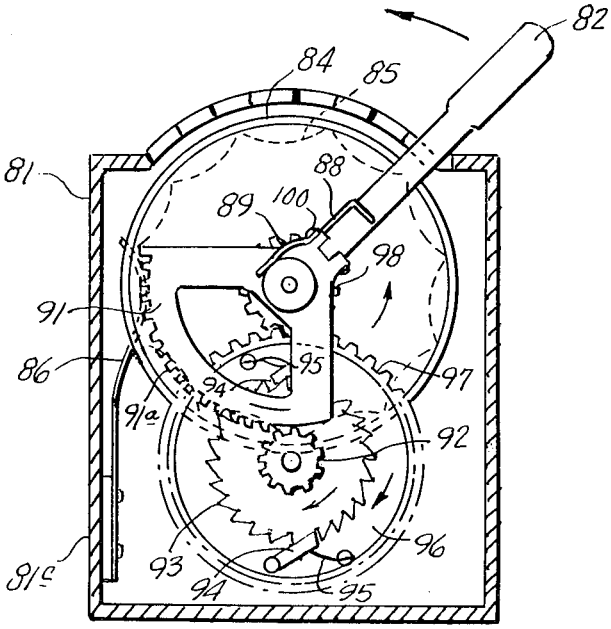

DRAG RACING GAME APPARATUS

FIELD OF INVENTION

This invention relates generally to a simulated auto racing game and more particularly to an auto drag racing game providing simulated conditions of a true drag race between two automobiles.

DESCRIPTION OF PRIOR ART

While automobile racing is extremely popular in this country as a spectator sport, most games in this area are directed to racing of the Grand Prix or stock car auto racing types. For example, see U.S. Pat. No. 3,738,659 to Partridge, U.S. Pat. No. 3,231,279 to Howarth et al. and U.S. Pat. No. 2,823,919 to Scruggs, all directed to games of this type. See also U.S. Pat. No. 3,566,484 to Sonnabend which also discloses a car racing game of sorts.

However, no attention has been paid in the game area to another form of auto racing which has attracted widespread spectator interest. This is the form of racing known as drag racing in which two cars compete in either one or a series of races over a measured quarter mile drag strip. Drag racing has its own characteristics which contribute to the intense excitement generated in the spectators. Such characteristics include the rapid acceleration of the cars, the short distances covered, the head-to-head competition and the numerous mechanical problems which can be encountered due to the strain placed upon the cars.

SUMMARY OF THE INVENTION

It is accordingly the principal object of the present invention to provide a board game which simulates the conditions encountered in a drag race.

A further and more specific object of the present invention is to provide a drag racing game in which characteristics of particular types of cars are taken into account in determining the outcome of the race.

Still another object of the present invention is to provide a drag racing game where in close races the elapsed time and speed of the car as it crosses the finish line are utilized to determine the winner.

A further object of the present invention is to provide a drag racing game wherein mechanical problems encountered by automobiles in an actual race are taken into account and affect the outcome of the race in a realistic manner according to the severity of the problem.

These and other objects of the present invention are accomplished by providing a playing board which has two parallel lanes divided into four transverse zones corresponding with the portions of the drag race run in first, second, third and fourth gears. Movement of the cars is controlled by random number selection means such as a pair of dice, or in another embodiment of the invention by rotation number wheel actuated by a manually manipulated gear shift lever which can be shifted into first through fourth gears, each shift of the lever causing the number wheel to rotate and randomly stop at a number from 2 through 12. The numbers thus randomly selected are utilized in determining the number of feet which each car may advance in any given gear by reference to a conversion chart with which each player is provided. Each conversion chart, of which approximately 50 may be provided, is calculated to produce racing performance characteristics of a well known type of car and driver. A plurality of cards are provided for simulating the various problems which may be encountered in a real-life race as the cars pass through the various zones. Collectively, these cards are know as the "Broke Deck" and individually set forth a particular type of problem such as a "blown transmission," which would put the car out of the race entirely, or a mechanical malfunction such as a faulty suspension which would slow the car down for the remainder of the race and any subsequent races in a particular round of competition. In a particularly close race, a miles per hour chart and elapsed time chart are provided for calculating the speed of the cars as they cross the finish line and their elapsed times in order to determine the winner.

Other objects, advantages and features of the present invention will become apparent from the following specification and accompanying drawings.

BRIEF DESCRIPTION OF THE DRAWINGS

FIG. 5 is a top or plan view of driver and car type characteristic cards utilized with the invention.

FIG. 6 is a top or plan view of a Broke Chart utilized with the invention.

FIG. 7 is a perspective view of the Broke Deck.

FIG. 8 is a perspective view of a drag racing automobile typical of the playing pieces utilized with the game of the present invention.

FIG. 10 is a top plan view of an alternative number selection means which can be utilized in place of the dice shown in FIG. 4.

FIG. 11 is a front elevational view in section of the number selection means of FIG. 10.

FIG. 12 is a side elevational view in section looking from the right side of FIG. 10.

DESCRIPTION OF THE PREFERRED EMBODIMENTS

Figure 1:
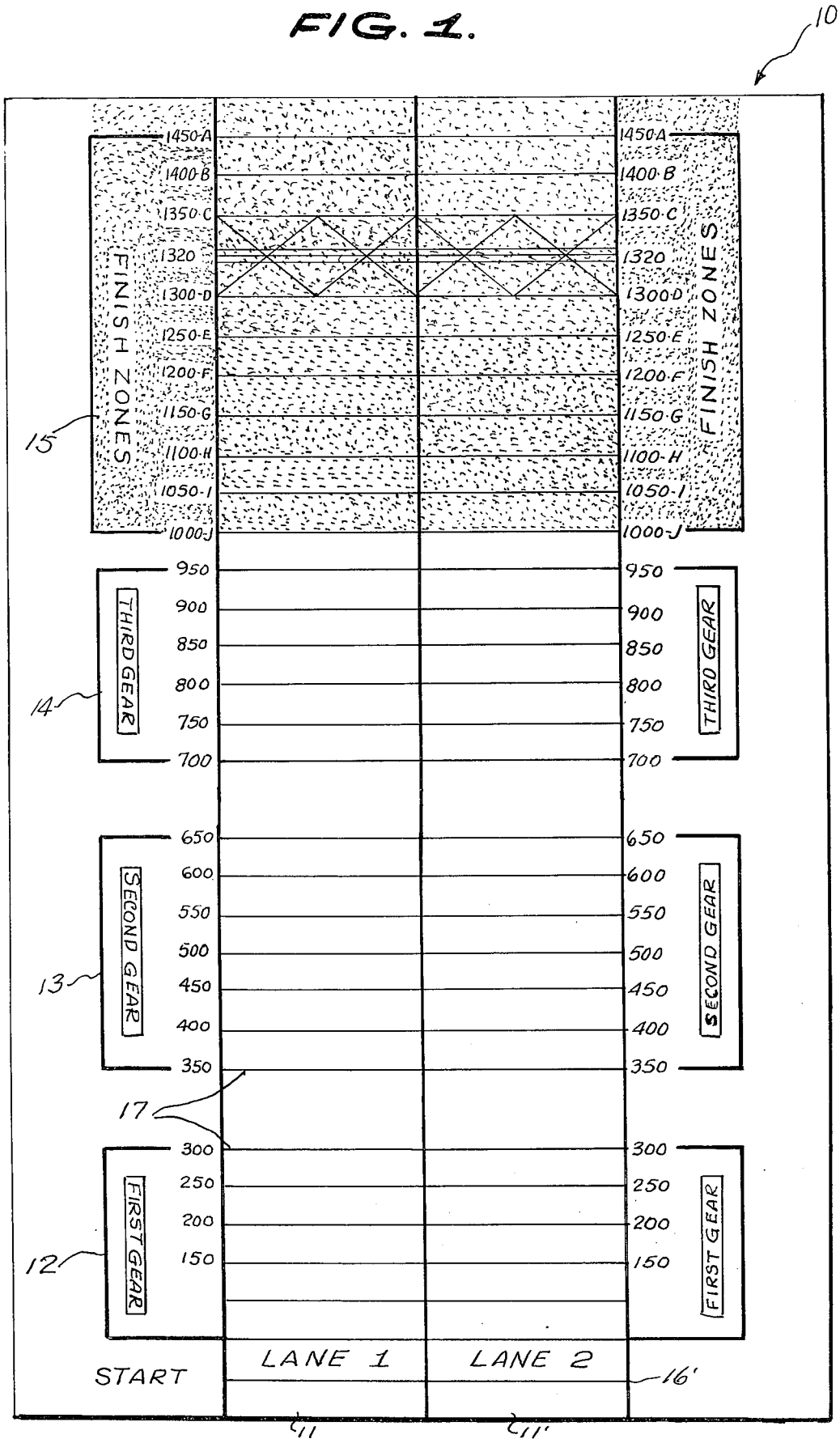
FIG. 1 is a top or plan view of the face of the playing board.

Referring first to FIG. 1, there is illustrated the game board 10 of the present invention. The game board 10 is longitudinally divided into two lanes 11 and 11' which constitute the course over which the playing pieces must travel. Lanes 11 and 11' are transversely divided by parallel lines 17 spaced at intervals of 50 scaled feet from starting line 16'. In order to create the impression of the distances traversed in an actual drag strip, lines 17 are designated by numeral indicia in terms of feet from 0 to 1,450, although the nominal finish line occurs at 1,320 feet or one-quarter of a mile.

Lines 17 are arranged in four distinct groups or zones. These include first gear zone 12 encompassing the distances from 0 to 300 feet; second gear zone 13 encompassing the distances from 350 to 650 feet; third gear zone 14 encompassing the distances from 700 to 950 feet and fourth gear or finish zones 15 encompassing the distances from 1000 to 1450 feet. In order to more clearly differentiate between zones 12 and 13 and zones 13 and 14, the lines 17 separating these two groups of zones are more widely spaced, although the distance between the lines still represents 50 feet. It will be noted that each of the lines 17 in zones 15 has associated therewith a letter designation A through J, as well as a numerical feet designation. No letter designation appears adjacent the nominal finish line at 1320 feet, since in playing the game this line is not used. Rather, the designation 1320 is merely used to provide a visual indication of the nominal finish line. As will appear more fully below, in playing the game, no car ever comes to rest on this line. The purpose for these indicia will appear subsequently in the description of the game's operation.

Figures 2, 3, 4:
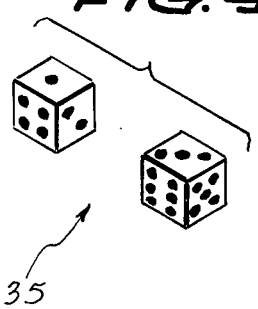
FIG. 2 is a top or plan view of the miles per hour chart.
FIG. 3 is a top or plan view of the elapsed time chart.
FIG. 4 is a perspective view of a pair of dice which may be utilized with the invention.

Referring now to FIG. 2, there is shown the miles per hour chart 20 which is utilized in helping to determine the winner of a close race. Appearing across the top of the chart and designating each of the columns of numbers are the letters A through J which correspond with the letters A through J in the finish zones 15 of game board 1. Appearing in the leftmost column are the numerals 2 through 12 which correspond with the numbers which may appear in the random number selection means to be described below. Thus, by utilizing the miles per hour chart 20 the speed of the car as it crosses the finish line may be determined for each combination of finish zone A through J and randomly selected number 2 through 12.

With reference now to FIG. 3, the elasped time chart 30 is depicted. The elapsed time chart is constructed in much the same manner as miles per hour chart 20, with each combination of finish zone A through J and randomly selected number 2 through 12 providing an elapsed time in seconds.

FIG. 4 depicts a typical pair of dice which may be utilized as the random number selection means for the game.

Turning now to FIG. 5, there is shown one of a plurality, which may be as many as 50, of the driver and car type characteristic cards 40 which form an essential part of the present invention. Each card contains the name of a well known drag racing driver, a pictorial representation of the particular car which that driver will be driving in the race, the name of the car as well as the number of engines which may be provided (one or two) and a strength rating which indicates the manner in which the particular car increases in performance as it advances through the various rounds of a plural round elimination contest. For example, in the particular card illustrated in FIG. 5, the car type depicted therein is rated at (100) (4). This rating means that beginning with the fourth round, if the car survives the first three rounds, it will advance an additional 100 feet in fourth gear beyond the advance indicated by the random number selection means as will be described more fully below. All this information is indicated on the upper portion 41 of the card.

The lower portion 42 of card 40 contains five separate rows of information corresponding with the start or first gear, second gear, third gear, fourth gear and "finish." The groups of numbers appearing to the right of each designation "start" through "fourth" refers to the number of feet which the particular car designated by the card 41 illustrated in FIG. 5 may advance when one of the numbers in that particular group is chosen by the player through the medium of the random number selection means. For example, if the player utilizing the particular card 40 shown in FIG. 5 were to select the number 7 at the very start of the race, he would advance his playing piece 200 feet. Similarly, if on the second round he were to select the number 4, he would advance his car 250 feet, and so on through the fourth round or fourth gear. As indicated on the first row alongside the start designation, a player selecting the number 12 will have committed a foul. This would automatically eliminate the player from that race, or in a plural round elimination contest from that round of the competition. In the row of indicia corresponding with third gear in the card 40 illustrated in FIG. 5, there appears the word BROKE adjacent the numeral 2. This means that if the player having the card corresponding to that shown in FIG. 5 were to select the number 2 on the third round or third gear, his car will have suffered a mechanical failure of some sort. The particular type of mechanical failure and the penalties to be exacted therefor are described in more detail hereinbelow with specific reference to FIGS. 6, 7 and 9. The information appearing in the row entitled finish will be explained in more detail below in connection with the description of an example of a typical game. It will be understood that each of the cards 40 is different from each of the other such cards and is designed to simulate to an approximate degree the particular characteristics of the car and driver which it is intended to represent. For example, a particular car might have better acceleration in first gear than other cars and consequently would advance a greater distance for the same number randomly selected than any other car would advance for the same number.

Figure 9:
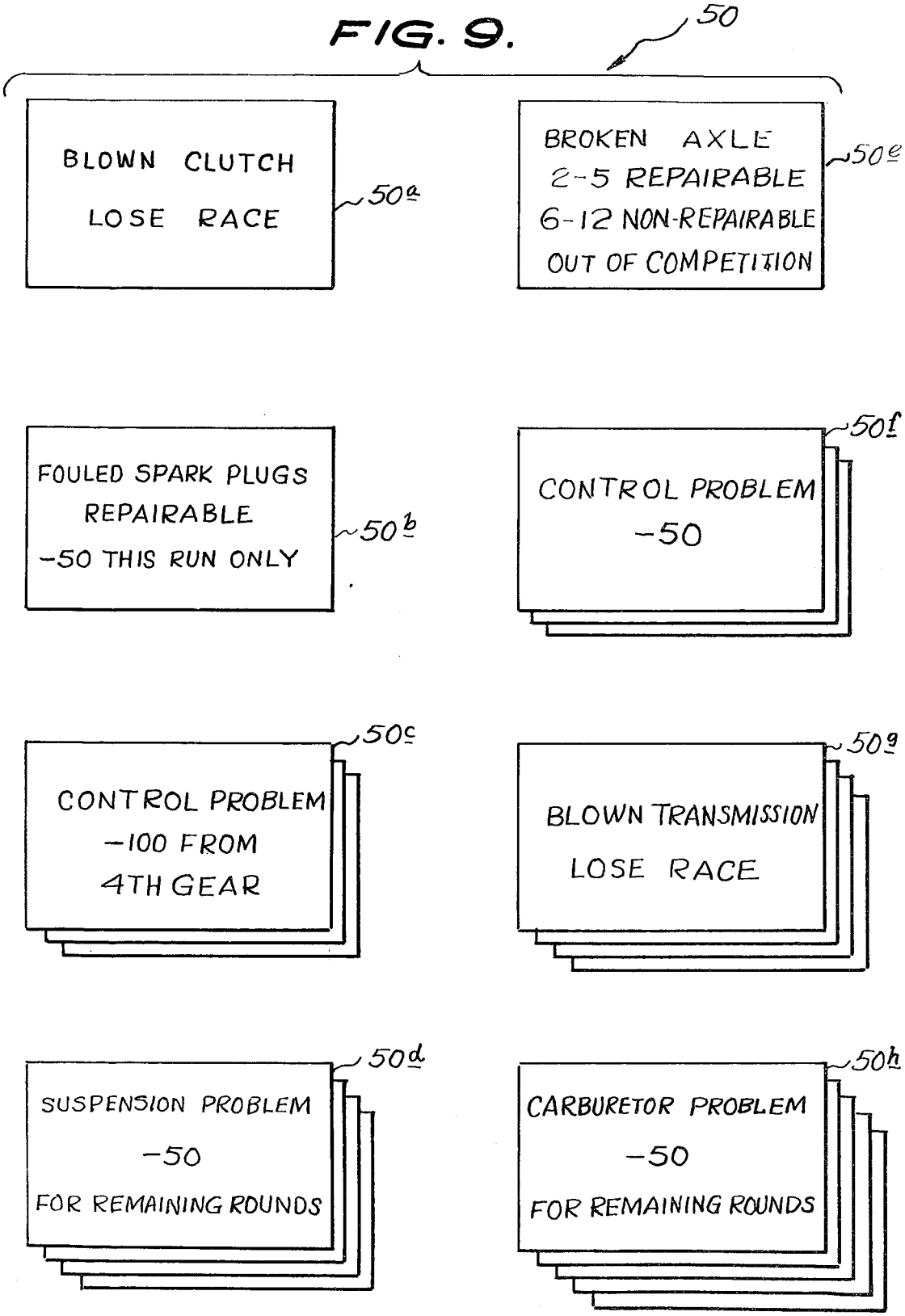
FIG. 9 is a top plan view of a typical collection of cards comprising the Broke Deck.

Turning now to FIGS. 6, 7 and 9, there is set forth the apparatus for determining the penalty to be exacted for any mechanical problem which may arise in the course of the race as simulated by the appearance of a BROKE condition in one of the cards 40, as described above. The BROKe cards are arranged face down in a BROKE deck as illustrated in FIG. 7 and in a typical embodiment may comprise 22 cards. Of course, a greater or lesser number of cards may be utilized.

Referring now to FIG. 9, a preferred distribution of the 22 cards among the various types of mechanical problems which could be encountered in a real life situation is illustrated. As shown in FIG. 9, each of the sets of BROKE cards 50*a* through 50*h* represents a different mechanical problem which might occur during the course of a race. The particular number of cards in each set is representative of the frequency with which the problem represented might occur. As illustrated, in a typical set of BROKE cards 50, there is one card 50*a* representing a "blown clutch,"one card 50*b* representing repairable fouled spark plugs, three cards 50*c* representing a control problem, four cards 50*d* representing a suspension problem, one card 50*e* representing a broken axle, three cards 50*f* representing a different sort of control problem, four cards 50*g* representing a "blown transmission" and five cards 50*h* representing a carburetor problem.

As utilized in the game of the subject invention, the BROKE cards as shown in FIG. 9 are placed face down in a stack as illustrated in FIG. 7. Then, if, during a particular segment of the race, a BROKE is selected by virtue of one of the numbers on a card 40, a BROKE card is selected from the deck. To illustrate, if the number 2 is selected for the particular driver and car characteristic card 40 shown in FIG. 5 during the car's advance in third gear, that particular car will have encountered a BROKE condition and the player having that card will select the top BROKE card from the BROKE deck. If either of the cards 50*a* or 50*g* is selected, the player will be out of the race. On the other hand, if either of cards 50*b* or 50*f* is selected the player will lose only 50 feet for the remainder of the race. In this particular instance, since the BROKE condition occurred during the third round or in the third gear, reference would next be made to the BROKE chart illustrated in FIG. 6. Adjacent third gear appears the figure 300 and thus for the particular example given above, the car would advance 300 minus 50 feet, or 250 feet in third gear. Similarly, if card 50*d* or 50*h* were selected, the car in question would be handicapped by a 50 feet deduction from each advance for the particular gear in which the problem occurred and for all remaining rounds if the event were a plural round contest. By the same token, if card 50*c* were selected, BROKE chart 60 would be referred to and 100 feet would be subtracted from the 500 feet figure as set forth therein and the car experiencing the control problem would only advance 400 feet in fourth gear.

Card 50*e* presents a slightly different type of situation. If this card is selected by the player, the random number section means is then utilized to determine whether or not the broken axle condition is repairable or non-repairable. If it is repairable as indicated by the selection of a number from 2 through 5, the car continues in the race. If, on the other hand, the condition is non-repairable, as indicated by a number from 6 through 12, the car is out of the competition.

FIG. 8 illustrates a typical miniature drag racing automobile which may be utilized as one of the playing pieces for the game of the subject invention. It will be understood that the other playing pieces will similarly be miniature racing cars of various configurations and colors.

Referring now to FIGS. 10, 11 and 12, there is shown an alternative form of the random number selection means which may be utilized with the game of the present invention. Essentially, this form of the number selection means comprises a gear shift box 80 having an outer casing 81, a gear shift lever handle 82 and a number window 83 in its upper surface. Also disposed in the upper surface of outer casing 81 is elongated slot 87 having cut-outs therein 87*a*, 87*b*, 87*c* and 87*d* representing respectively first, second, third and fourth gears.

Disposed adjacent each cut-out 87*a*, 87*b*, 87*c* and 87*d* are indicia 200*a*, 200*b*, 200*c* and 200*d* representing respectively first gear, second gear, third gear and fourth gear.

Disposed within outer casing 81 and mounted between side walls 81*a* and 81*b* are a first shaft 89 and a second shaft 90. Mounted for free wheeling rotation on shaft 89 is number wheel 84 having the numbers 2 through 12 displayed thereon in any arbitrary sequence and disposed with respect to number window 83 such that only one number at a given time is viewed through number window 83 when number wheel 84 is at rest in a particular position. The outer periphery of number wheel 84 is provided with detents 85, as best seen in FIG. 12, for indexing the numbers with respect to number window 83, in cooperation with lightweight spring 86, mounted in a conventional manner on front wall 81*c* of outer casing 81. Thus, when rotary motion is imparted to number wheel 84 through a mechanism to be described hereinafter, the wheel will freely rotate until it slows down through its own inertia and the light pressure exerted by spring 86, at which time spring 86 will engage one of detents 85 and cause an arbitrarily selected number from 2 through 12 to be displayed through window 83.

Rotatably mounted on shaft 89 is gear segment 91 having gear teeth 91*a* and being retained in place by collar 99. Flexibility attached to gear segment 91, as by hinge 100, is handle 82 which is also urged inwardly into engagement with cut-outs 87*a* through *d* by spring 88.

Mounted on shaft 90 are spur gear 92 and ratchet wheel 93 which are fixedly secured to each other. Thus, when spur gear 92 is caused to rotate on shaft 90, ratchet wheel 93 will rotate along with it. Also mounted on shaft 90 is drum 96 having dogs 94 secured thereto and urged into engagement with the teeth of ratchet wheel 93 by springs 95.

Fixedly secured to the side of drum 96 opposite dogs 94 is gear 97 which is designed to mesh with gear 98, fixedly secured to the side of number wheel 84.

In operation, the random number selection means illustrated in FIGS. 10, 11 and 12 causes a number from 2 to 12 randomly appear at window 83 each time gear shift lever 82 is moved into first, second, third or fourth gears. As lever 82 is moved, for example, into first gear, gear teeth 91*a* of gear segment 91 engage the teeth of spur gear 92 causing it to rotate along with ratchet wheel 93 in the direction shown by the arrows in FIG. 12. As a consequence, the teeth of ratchet wheel 93 engage dogs 94, causing drum 96 and gear 97 to rotate in the same direction. This sudden movement causes gear 97 to impart a spinning motion to gear 98 which spins number wheel 84 until it is indexed at one particular randomly selected number by the interaction of spring 86 and one of the detents 85, as described above. Thus, the player utilizing random number selection means 81 performs an operation closely akin to that performed by the drag racing driver in shifting into various gears while at the same time selecting a number which permits his car to advance in the manner described above. Consequently, the enjoyment of the player is enhanced by the relationship between an operation actually performed by racing car driver and the advance of his playing piece through the various stages of the game.

In playing the game of the instant invention, each player chooses a driver and car type characteristic card 40 and a playing piece 70 and places it in either lane 1 or lane 2 at starting line 16'. Dice 35 are then thrown or number selection means 80 is utilized to determine which player moves first. Each player then alternately moves his car through first, second, third and fourth gears by the use of dice 35 or random number selection means 80 in conjuction with the previously selected driver and car type characteristic cards 40. In the course of the race, as described above, the cars may encounter various types of BROKE conditions, in which case reference is made to the BROKE cards illustrated in FIG. 9 and BROKE chart 60 shown in FIG. 6. If a foul is encountered, as by selecting the number 12 in the start position for the card illustrated in FIG. 5, the car is out of that race or that leg of a race having a plurality of legs.

To briefly illustrate the manner in which one car proceeds through first, second, third and fourth gears, reference is now made to FIG. 5 and the particular driver and car type characteristic card illustrated therein. Assuming that in the start position or first gear, the player having this card randomly selects the number 11. He then moves his playing piece 70 to transverse line 17 on playing board 10 bearing the designation 250. On the next round assume the same player randomly selects the number 4. His playing piece will then be advanced to the transverse line 17 marked 500. On the next round, assume that the number 2 is randomly selected. This indicates a BROKE condition and a BROKE card 50 is then selected as previously described. For purposes of illustration, it will be assumed that the player has selected the card designated **50*b* in FIG. 9 bearing the legend "fouled spark plugs repairable —50 this run only." Reference is then made to BROKE chart 60 illustrated in FIG. 6 and 50 feet is subtracted from the 300 feet figure appearing opposite third gear in the chart. The playing piece will then be advanced 250 feet to the line 17 marked with the designation 750 in the third gear zone. On the next round of the race, the player will again randomly select a number in the manner described above, and, assuming that the number 9 is chosen, he will advance his playing piece 500 feet or to the line in the finish zone marked 1250-E.**

It will be understood that the other player will have advanced his car in the same manner as described above but, of course, with reference to a different driver and car type characteristic card 40. The game is designed such that both players will enter the finish zones on the fourth gear advance. If the distance between the cars is greater than 50 feet, the leading car wins the race. If the difference between the cars is 50 feet or less, the random number selection means is utilized again with reference to the line in lower portion 42 of card 40 marked finish. For the particular card illustrated in FIG. 5, a number selected from 2 to 11 indicates that the car finished "in" while a selection of the number 12 indicates that the car finished "out". If one car finishes in and the other finishes out the car finishing in wins the race. If both finish in or out, reference is then made to elapsed time chart 30 illustrated in FIG. 3 to determine the winner. As described above, this chart is utilized by correlating the letter appearing at the top of each column of numbers with the particular line in the finish zone where the car came to rest after completing the race. Let us assume for the particular race in question the car competing with the player having the card illustrated in FIG. 5 came to rest at the line designated 1200-F. As noted above, the other car finished at 1250-E. Let us further assume that both cars finished in as determined in the manner described above. At this point, each player would use the random number selection means to determine his elapsed time from the elapsed time chart 30. Assuming that the first player selected the number 2, his elapsed time would be 9.1 seconds as shown in column E. Assuming further that the second player also selected number 2, his elapsed time would be 9.2 seconds as shown in column F. The first player would then be the winner, since he had a lower elapsed time. This same procedure would be followed in all similar cases, i.e., where the finishing distance between cars is 50 feet or less and both cars finish in or out.

It will be understood that for any given drag race the elapsed time chart may be used in order to determine the winner. It may be used, also, to compile performance statistics as in the case of a true-to-life drag race where elapsed time figures are kept for each car. Similarly, the miles per hour chart 20, illustrated in FIG. 2, may be utilized to compile performance statistics. It should be understood that these "performance" statistics do not relate to the playing of the game, except insofar as the elapsed time chart 30 is used to determine the winner of the race, as explained above. Rather, these performance statistics afford the statistically minded player an opportunity to indulge his fancy and compile statistics for each car of the type kept in assessing the overall performance record of a true-to-life drag racing car.

The present game may be used either as a single event race or as a multi-car elimination contest or in many other ways which will be readily apparent to those participating in the game. In a multi-round event, as previously described, the strength rating of each car comes into play. For the particular car characteristic set forth in the card 40 shown in FIG. 5, a car would advance an additional 100 feet in fourth gear beginning with the fourth round, if it survives the first three rounds.

It will be apparent to those skilled in the art that the specific embodiments illustrated herein are merely exemplary of the present invention and that other methods and apparatus for practicing the invention may be devised without departing from the true scope thereof as defined in the appended claims.

What is claimed is:

1. In an automobile racing game:

a. a playing board divided into a plurality of parallel paths;

b. each of said paths being divided into a plurality of zones and bearing spaced distance indicia;

c. a plurality of playing pieces equal in number to the number of said paths for advancing along each said paths in discrete steps through each of said zones;

d. a plurality of control means each bearing indicia including numbers simulating the racing performance characteristics of a different automobile, for controlling the advance of each of said playing pieces through each of said zones in accordance with said racing performance characteristics; and e. means for randomly selecting one of the numbers on said control means.

2. The game set forth in claim 1 wherein each of said plurality of zones represents the distance normally traversed by a racing car in a particular gear and said numbers on the control means are associated with distance indicia which permit each of said playing pieces to advance only from one zone to the next zone according to one of said randomly selected numbers.

3. The game set forth in claim 2 wherein said control means bears indicia representative of the occurrence of a mechanical problem for at least one of said gears and in association with at least one of said randomly selected numbers and means for penalizing a car upon the occurrence of a mechanical problem.

4. The game set forth in claim 3 wherein said penalizing means comprises a plurality of penalty cards bearing indicia representative of a plurality of different mechanical problems, one of said cards being selected by a player when a randomly selected number indicates the occurrence of a mechanical problem via said control means, each of said penalty cards further bearing indicia representative of a distance penalty to be imposed on the advance of the playing piece of the player selecting said card.

5. The game set forth in claim 1 wherein said zones include a finish zone comprising a plurality of said spaced distance indicia, at least some of said distance indicia within said finish zone having further unique distinguishing indicia associated therewith; and means for determining the speed and elapsed time of each playing piece in accordance with the further distinguishing indicium associated with the distance indicium at which said playing piece terminates the race within said finish zone and with a further randomly selected number.

* * * * *